US005408762A

United States Patent [19]

Hilgarth

[11] Patent Number: 5,408,762

[45] Date of Patent: Apr. 25, 1995

[54] ADJUSTMENT SYSTEM FOR SKI BOOTS HAVING AN ARTICULATED COLLAR

[75] Inventor: Kurt Hilgarth, Graz, Austria

[73] Assignee: Dynafit Skischuh Gesellschaft m.b.H., Graz, Austria

[21] Appl. No.: 983,375

[22] Filed: Nov. 30, 1992

[30] Foreign Application Priority Data

Dec. 2, 1991 [AT] Austria ..... 2390/91

[51] Int. Cl.[6] ..... A43B 5/04

[52] U.S. Cl. ..... 36/120; 36/117

[58] Field of Search ..... 36/117–121, 36/109, 50.5

[56] References Cited

U.S. PATENT DOCUMENTS

| | | | |
|---|---|---|---|
| 3,543,421 | 1/1970 | Ader . | |
| 3,633,291 | 1/1972 | Caporicci . | |
| 4,367,885 | 1/1983 | Ramer | 36/121 |
| 4,404,758 | 9/1983 | Kopp | 36/121 |
| 4,501,078 | 2/1985 | Kopp . | |
| 4,519,149 | 5/1985 | Pozzobon | 36/121 |
| 4,631,839 | 12/1986 | Bonetti et al. | 36/50.5 |
| 4,870,723 | 10/1989 | Pozzobon et al. | 36/50.5 |
| 4,932,143 | 6/1990 | Benetti | 36/120 |
| 4,962,595 | 10/1990 | Perner | 36/121 |
| 5,101,581 | 4/1992 | Hilgarth | 36/120 |

FOREIGN PATENT DOCUMENTS

| | | |
|---|---|---|
| 0434663 | 6/1991 | European Pat. Off. . |
| 2341283 | 9/1977 | France . |
| 2513496 | 1/1983 | France . |
| 2057094 | 3/1972 | Germany . |
| 9200682 | 1/1992 | WIPO . |

*Primary Examiner*—Paul T. Sewell
*Assistant Examiner*—Thomas P. Hilliard
*Attorney, Agent, or Firm*—Ladas & Parry

[57] ABSTRACT

An adjustment system for ski boots includes a collar which can be swivelled in relation to a shell, the forward pivotal movement of which may optionally be damped by a damping spring which on one side is supported on an offset formation of the collar and on the other side by a bolt mounted in the shell. The shell side end of the bolt is mounted by means of a ball joint in a sleeve which may itself designed as such a sleeve. The pivoting movement of the collar in a rearward direction may be limited by an adjustable stop member, which is formed by a sleeve mounted in the shell. The sleeve comprises at least one catch formation into which an externally operable counter catch formation engages, with the sleeve in angular staggered relationship to at least one catch formation and comprising a guide member directed parallel to the access of the sleeve and extending over the axial length thereof, thus co-acting with a counter member provided in the shell.

12 Claims, 2 Drawing Sheets

ADJUSTMENT SYSTEM FOR SKI BOOTS HAVING AN ARTICULATED COLLAR

BACKGROUND OF THE INVENTION AND PRIOR ART

The invention relates to an adjustment system for ski boots including a collar which can be swivelled in relation to a shell, and the inclination of which is adjustable by virtue of a bolt fried in the collar and mounted in the shell in a level adjustable and positionally fixable manner, and the forward pivotal movement of which may optionally be damped by a damping spring provided on the heel side and which on the one side is supported on a support region, e.g. an off-set formation of the collar and on the other side by a bolt mounted in the shell in a level adjustable and positionally arrestable manner, the shell side end of the bolt being mounted in a manner allowing limited pivoting in the direction of travel by means of a ball joint in a sleeve in a level adjustable and positionally fixable manner or is itself designed as such a sleeve, or wherein the pivoting movement of the collar in a rearward direction is limited by an adjustable stop member, such stop member being formed by a sleeve mounted in the shell in a level adjustable and positionally fixable manner, wherein in any event the sleeve comprises at least one catch formation into which an externally operable counter catch formation engages.

By way of example a ski boot is known from EP-A-434 663 in which the pivoting of the collar in relation to the shell is damped by a damping spring provided on the heel side and the bolt loaded by the damping spring is mounted in the shell in a level adjustable and positionally fixable manner. Likewise the connection of the bolt loaded by the damping spring to the level adjustably guided sleeve by means of a ball joint is disclosed in that printed publication. In order to be able to rapidly adjust the inclination of the collar in relatively large steps the sleeve is provided with at least two catch formations, axially spaced apart and angularly off-set in relation to one another into which an optionally externally operable counter catch member engages. In order on the one hand to make it possible for the foot to be easily flexed in the ski boot when walking, yet rapidly and easily to restore the desired adjustment of the forward inclination of the collar in relation to the shell, each catch formation is associated with a groove into which a projection of the locking pin serving as the counter catch member engages even whilst the locking pin has been withdrawn from the catch formation.

In order to change the coarse adjustment of a greater or lesser forward inclination the sleeve must be turned in the one or other direction by means of a coin or a screwdriver-like tool, inserted into appropriate slots in the sleeve. This causes the locking pin to enter into the track of a groove leading to a different catch aperture due to an axial movement of the sleeve.

In order to permit such turning the engagement of the projection of the locking pin and the aforesaid groove must not be too deep, which on the other hand will not preclude an involuntary turning of the sleeve. Moreover due to the required turning of the sleeve by means of a tool a risk arises that the sleeve and more particularly the surrounding parts of the collar of the ski boot are damaged. For example when applying a screwdriver or the like used as a lever for turning the sleeve, it may easily happen that parts of the entry opening to the sleeve are broken out. This may happen particularly if the turning of the sleeve is resisted substantially by the groove-projection combination in order to inhibit involuntary rotation.

The ski boot according to FR-PS 2 341 283 likewise permits a coarse adjustment of the forward inclination. This takes place by a screw-like member being past and screw connected through a lug extending rearwardly from the shell and by a bolt connected to the collar which for that purpose is provided with a plurality of bores one above the other. However, this construction suffers from the drawback that the release of the pivoting movement for walking purposes cannot be provided in a rapid and simple manner, various manipulations and a tool being required for that purpose. The modification illustrated in FIG. 3 of the aforesaid French printed publication in which the coarse adjustment is combined with a closure means for the boot has the disadvantage that the liberation for walking is only possible while this single closure of the boot is open, wherefore a secure fit within the boot during walking is not provided. In addition the open closure, particularly its loosely projecting pans such as a clasp, etc., would impede walking and involve a risk of entanglement.

With a view to the stated disadvantages of the conventional constructions it is the object to the invention to provide an adjustment system for ski boots of the construction types referred to in the introduction, wherein these drawbacks are overcome. It should be possible in a simple and rapid manner to change from a predetermined forward inclination to an adjustment wherein the pivoting of the collar in relation to the shell is liberated for comfortable walking. In order to once again permit the mutual engagement of the catch and counter-catch in a reliable manner, the sleeve comprising such catch formation is to be secured against involuntary rotation reliably and by measures permitting simple manufacture.

GENERAL DESCRIPTION OF THE INVENTION

This object is attained in accordance with the invention in that the sleeve in angularly staggered relationship to the at least one catch formation, preferably exactly opposite, comprises a guide member directed parallel to the axis of the sleeve and extending over an axial length, which co-acts with a counter member provided in the shell such that when the fixation formed by the catch formation and counter catch member of the sleeve is released turning of the latter is prevented, whilst an axial displacement is still possible.

In order to be able to select a plurality of forward inclinations in a rapid and simple manner without having to use a tool which might damage the ski boot, provision is made that the sleeve comprises at least two axially spaced apart catch formations, the connecting line of which is positioned parallel to the axis of the sleeve and into which the counter catch member engages as selected, the axial length of the guide element being at least as large as the maximum axial spacing of the outer catch members. This is so because it was found in practice that it is of less importance to the skier to have automatically reset the same forward inclination after each liberation for walking purposes ("memory effect") but rather that the ski boot can be adjusted in a rapid and simple manner to meet different conditions of use and provide different relative positions between the shell and the sleeve which depend on many parameters.

According to a feature of the invention a spring element, preferably a coil spring is provided between the sleeve and the shell in the case of the adjustable stop member formed by the sleeve, which spring element is supported at its upper end by part of the sleeve and at its other end by the shell, preferably the bottom of the cavity accommodating the sleeve, exercising a force onto the sleeve acting in the direction of the collar. By this expedient the sleeve forming the stop member is automatically brought into the extreme outer position and can them be fixed immediately but can on the other hand be brought into any other desired position, there to be fixed simply by being pressed into the cavity by rearwards swivelling of the collar.

This is also assisted by the fact that the sleeve in the unloaded state of the spring element advantageously occupies a position in which one catch formation, preferably the lowermost catch formation is exactly in a position suitable for engagement by the counter catch member.

If in the adjustment system according to the invention the catch formations take the form of apertures as disclosed in EP-A434 663, axially spaced apart and the counter catch member takes the form of a locking bolt linked to an operating lever and which when loaded by a spring element is forced by way of a locking pin into the aperture, the invention advantageously provides that the guide element is provided in the form of a groove or elongate aperture in the sleeve and the counter element takes the form of a guide pin engaging the groove or the elongate aperture and not inhibiting axial displacement. This construction is functionally reliable and at the same time can be manufactured in a simple manner and therefore is relatively inexpensive.

In order to be able to easily disassemble the ski boot including the adjustment system according to the invention for repair work, respectively be able to easily replace the adjustment system when defective, a further feature of the invention provides that the guide pin is mounted removably from the groove or the elongate aperture in a direction normal to the axis of the sleeve, preferably in a bore of the shell which is directed normal to the axis of the sleeve and which on the outside can be closed by a removable closure element.

A particular protection of the material of the ski boot surrounding the adjustment system, providing an advantageous application of the forces exercised over a large surface area can be attained in that according to a further feature the guide pin is applied to a guide bolt, the guide bolt and the locking bolt being guided in a second sleeve, fitted transversely to the first mentioned sleeve.

In order to avoid that in the released position for walking, parts projecting from the ski boots provide a risk of becoming entangled with other objects respectively equipment of the user, provision is made in the modification of the construction wherein the adjustment trajectory of the locking bolt during pivoting of the locking lever from the locked position into the unlocked position equals the depth by which the locking pin engages into the catch aperture, that according to a further feature the locking lever, when not in the locking position, is pivotal about an axis normal to the trajectory of the locking bolt in a circular bore of the second sleeve and, in a position turned by 180°, can once again be swung into the locked position, in spite of the locking bolt remaining in its unlocked state.

Further features of the invention will be further explained in the following description by way of two preferred working examples.

BRIEF DESCRIPTION OF THE DRAWINGS

In this context

DESCRIPTION OF SPECIFIC EMBODIMENTS

Figure 1:
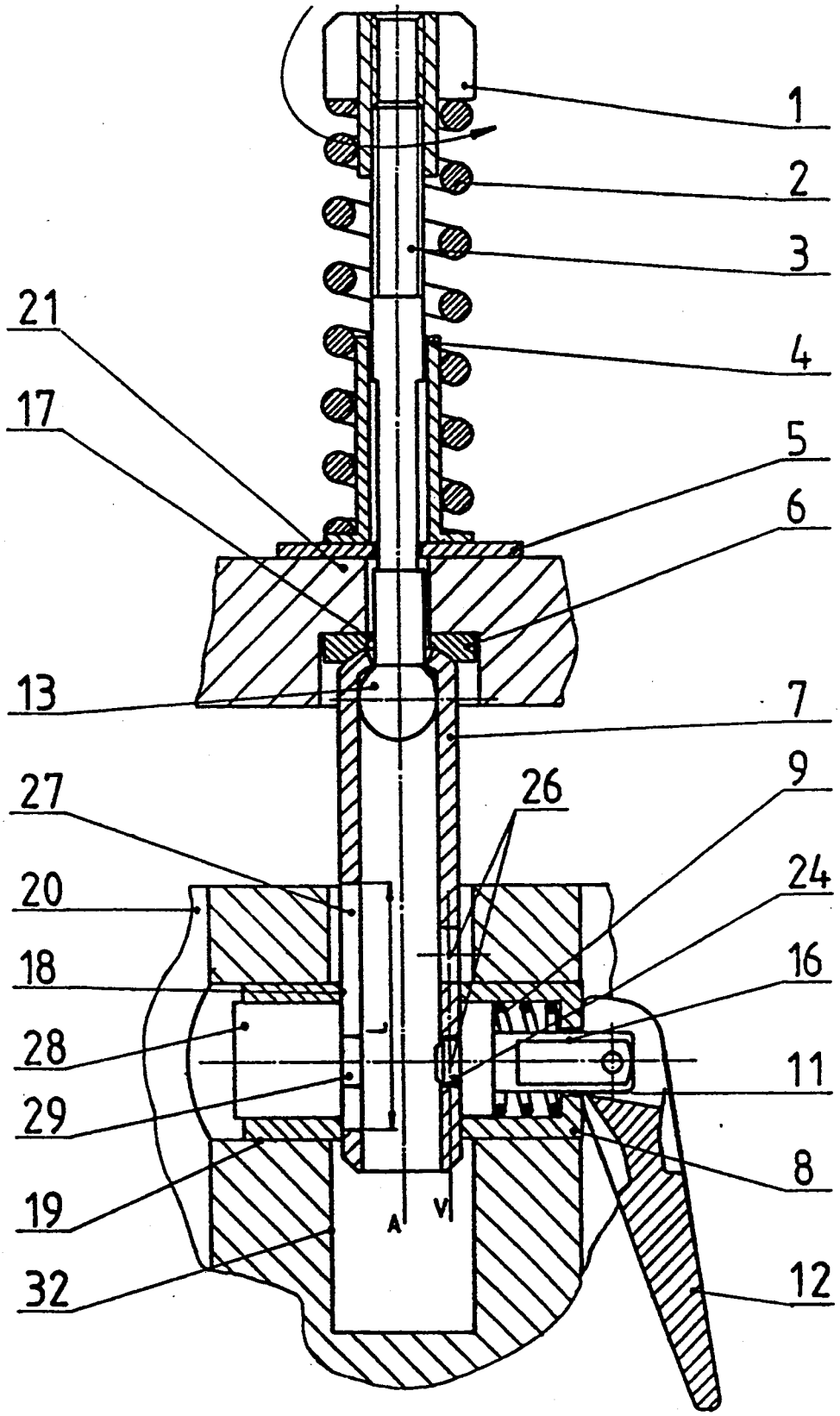
FIG. 1 represents an axial section of an adjustment system according to one embodiment of the invention, installed in the ski boot

A threaded bolt 3 embraced by a coil spring 2 is accommodated in a cavity on the heel side of a ski boot composed of an under shell and a collar. The coil spring 2 at one end is supported against a nut 1 screwed onto the upper end of the threaded bolt 3, by which the pretensioning of the spring can be changed for adjusting the desired damping effect. At its opposite, lower end the coil spring 2 is supported against a laterally projecting time of a sleeve 4 which at its lower edge rests on a washer 5 which bears against an off-set region 21 of the collar of the ski boot.

Of course it would be equally effective if the upper end of the coil spring 2 were to be fixed so that the damping effect would always be kept constant. A further modification is conceivable in which the bolt 3 is fixed in the collar of the ski boot, the coil spring 2 being omitted. In such embodiment the forward inclination would be fixable in a defined position without a damping effect.

In the illustrated advantageous working example of the adjustment system according to the invention including damping, a ball 13 is provided at the lower end of the threaded bolt 3 which is held in the upper end of a level adjustable but flexible sleeve 7. For that purpose the threaded bolt 3 passes through the dome of the sleeve 7 inside a bore 17 which provides a tolerance for a limited pivotal movement in the travelling direction of the ski boot.

This embodiment offers the advantage that in the region of interconnection of the threaded bolt 3 and the sleeve 7 the force is deflected to avoid forces acting onto the ski boot in the direction of travel which would cause dilation of the ski boot in the ankle region, thereby interfering with the fixation of the foot in the boot. However, it stands to reason that in the event where only slight pivotal movements between the collar and the shell occur respectively if from the outset the mounting positions are planned suitably with negligible forces in the longitudinal direction of the boot, an integral design in one part may also be selected in which the bolt 3 forms a rigid unit and where for connection to the shell, its lower end takes the form of a sleeve.

The sleeve 7 is fitted into a transverse bore 18 of a second sleeve 8 which in its turn is mounted in a bore 19 of the shell of the ski boot. A locking lever 12 is provided in a known manner which is hinged to a locking bolt 16 which by way of a locking pin 24, biased by a spring 9, engages into at least one catch formation 26 taking the form of an aperture in the sleeve 7. In the illustrated example two axially spaced apart apertures 26 are provided. Viewed in the direction of the axis A of the first sleeve 7 these are provided exactly one above the other, i.e. their connection line V is parallel to the axis A.

In order to prevent turning of the first sleeve 7 while the locking lever 12 is brought into an unlocked position and the locking pin 24 no longer engages the apertures 26, a guide element which preferably takes the form of an elongate hole 27 in the sleeve 7 is provided angularly displaced in relation to the catch formations 26, preferably exactly opposite thereto. This elongate bolt 27 which advantageously is displaced by 180° in relation to the catch apertures 26, is engaged by a counter element which preferably likewise takes the form of a guide bolt 28 guided in the second sleeve 8 and which at its end facing the sleeve 7 is provided with a guide pin 29 which does not interfere with the axial displacement of the sleeve 7. This pin 29 projects into the elongate aperture 27 and prevents such turning.

Instead of the elongate hole extending to the central cavity of the sleeve, it is of course possible also to provide a groove as a guide element. It is also conceivable to provide a groove in the shell 20 of the ski boot in which a projection on the sleeve 7 is guided. The invention is not restricted to the described combinations of guide elements and counter elements respectively to specific arrangements of these elements.

Also the arrangement of guide and counter elements must not necessarily be exactly opposite to the combination of catch and counter catch formations, although this offers the advantage that both arrangements can be mounted in the same sleeve respectively the same rebate or bore in the shell 20.

The axial length of the groove respectively the elongate aperture 27 is at least as large as the maximum axial spacing of the outermost catch formations 26 and is preferably greater, in order to permit an adequate pivoting between the collar and the shell during walking and thus an unimpeded flexing of the ankles.

Figure 2:
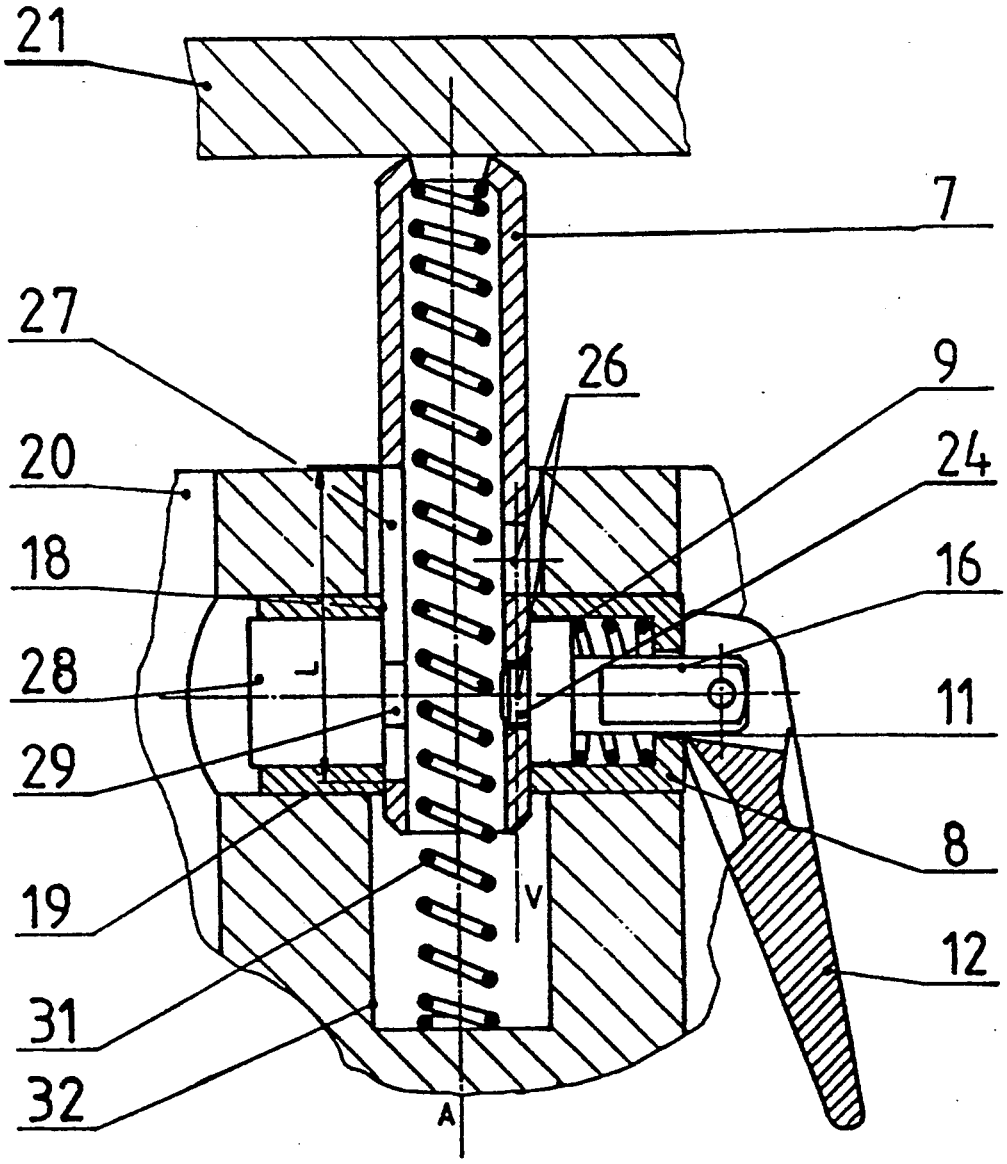
FIG. 2 represents an axial section of an installed adjustment system according to a second embodiment.

In the embodiment illustrated in FIG. 1, the rearward pivoting is limited by a disc 6 bearing against the upper parts of the sleeve 7, this disc 6 being provided between the off-set portion 21 of the collar against which also the sleeve 4 and the coil spring 2 are supported via the intervening washer 5, and the upper portion of the sleeve 7. The embodiment illustrated in FIG. 2 represents an example for a case in which the aforesaid sleeve 7 merely serves as a stop member for the rearward pivoting of the collar 21 whereas pivoting forwardly is totally released and neither is impeded nor damped by any arrangement co-acting with the shell 20 of the boot. In that case, as illustrated in FIG. 2 a spring element, preferably a coil spring 31, is advantageously provided which in its upper region bears against a part of the sleeve 7 and at its other end bears against the shell 20 of the ski boot. In order to reduce the space for accommodating this system to a minimum the aforesaid coil spring 31 is preferably provided inside the sleeve 7 and bears against the inside of the upper end of the sleeve 7. The opposite end in such embodiment bears against the bottom of the cavity 52 in the shell 20 accommodating the sleeve 7. The spring is advantageously so selected and designed that the sleeve 7, when the spring element 31 is unloaded, is in a position wherein one catch formation 26 is exactly in a position suitable for entering into engagement with the counter catch member. Whenever, as in the example shown, a plurality of catch formations 26 are provided, the most favourable embodiment is that wherein the lowermost catch formation is in the aforesaid position, i.e. in the unloaded position the spring 31 moves the sleeve 7 into that position which extends maximally from the shell of the ski boot.

Pressure exercised onto sleeve 7 when the locking lever 12 is open is now able, by overcoming the spring loading acting onto the sleeve 7 in the direction of the collar of the ski boot, to now move any selected catch formation into a position suitable for engagement with the counter catch member, thereby bringing the stop formation into the desired position for the rearward pivoting of the collar, there to be locked.

The positioning of the guide bolt 28 and the guide pin 29 provided thereon which is also provided in the present system, in the second sleeve 8 in which the counter catch member as well is movable, offers the advantage of a simplified manufacture and the further advantage that this guide pin 29 is slidable in this sleeve 8 and accordingly is guided to be removed in a direction normal to the axis of the sleeve 7 from the groove or elongate aperture 27. Of course it is also possible to provide only one bore 19 in the shell 20, positioned preferably normal to the axis of the adjustable sleeve 7, in which the guide pin 29 is guided removably from the elongate aperture 27 serving as a guide element. On the outside this bore 19 is advantageously closed by a removable closure element (not illustrated), which in the closing position keeps the guide pin 29 pressed into the groove or elongate aperture 27. In the event of repair work or replacement of the adjustment system according to the invention, the guide bolt 28 after removal of the closure element can be removed together with the guide pin 29 from the elongate aperture 27 and the sleeve 7 can be withdrawn from the sleeve 8, once the locking by the catch 26 and the counter catch 28 has been released.

FIG. 1 furthermore illustrates an embodiment of the upper portion of the locking lever 12 which ensures that the lever 12 can be further pivoted beyond the unlocking position in which the axis of the sleeve 8 and the longitudinal axis of the lever 12 are essentially parallel, and simultaneously the counter catch member 24 remains in a position in which it does not engage into any of the catch formations 26. By virtue of the locking lever 12 being mounted on the axle which is guided in a circular bore on the front side of the sleeve 8, it is possible to turn this lever 12 about this axis and with a suitable design of the lever and rebate in which the latter is to be accommodated, it is made possible for the lever 12 after being swung into a position displaced by 180° to again be swung back such that the locking bolt 24 will, however, remain in the unlocked position as aforesaid. This permits a free pivoting of the collar in relation to the shell, while simultaneously the risk of entanglement is avoided by the locking lever 12 being folded away.

What we claim is:

I claim:

1. Adjustment system for ski boots including a collar which can be swivelled in relation to a shell, and the inclination of which is adjustable by virtue of a bolt fixed in the collar and held in the shell in a level adjustable and positionally fixable manner, the shell side end of the bolt being mounted in a manner allowing limited pivoting in the direction of travel by means of a ball joint in a sleeve, wherein the sleeve comprises at least two axially spaced apart formations having a connecting line position parallel to an axis of the sleeve, an externally operable first counter catch formation engaging in the spaced apart formations, wherein the sleeve, in angularly staggered relationship to the first counter catch formation, comprises a guide member directed parallel to the axis of the sleeve and extending over an axial length, which co-acts with a first counter catch member provided in the shell such that when a fixation formed by the first counter catch formation and a second counter catch member of the sleeve is released, turning of the latter is prevented, whilst an axial displacement is still possible, the axial length of the guide member being at least as large as the maximum axial spacing of the first counter catch formation, at least one of the counter catch formations taking the form of apertures, axially spaced apart and the first and second counter catch members take the form of a locking bolt linked to an operating lever which when loaded by a spring element is forced by way of a locking pin into an aperture, and wherein a guide element is provided in the form of a groove or elongated aperture in the sleeve and the first counter catch formation takes the form of a guide pin engaging the groove or the elongated aperture and not inhibiting axial displacement.

2. System according to claim 1, wherein the guide member is exactly opposite to the first catch formation.

3. System according to claim 1, wherein the sleeve in the unloaded state of the spring element occupies a position in which one catch formation, is exactly in a position suitable for engagement by the counter catch member.

4. System according to claim 3, wherein one catch formation is a lower catch formation.

5. System according to claim 1, wherein the guide pin is mounted removably from the groove or the elongate aperture in a direction normal to the axis of the sleeve.

6. System according to claim 5, wherein the guide pin is accommodated in a bore of the shell which is directed normal to the axis of the sleeve and which on the outside can be closed by a removable closure element.

7. System according to claim 5, wherein the guide pin is applied to a guide bolt, the guide bolt and the locking bolt being guided in a second sleeve, fitted transversely to the first mentioned sleeve.

8. System according to claim 1, wherein the adjustment trajectory of the locking bolt during pivoting of the operating lever from the locked position into the unlocked position equals the depth by which the locking pin engages into the aperture, wherein the locking level, when not in the locking position, is pivotal about an axis normal to the trajectory of the locking bolt in a circular bore of the sleeve and, in a position turned by 180°, can once again be swung into the locked position, in spite of the locking bolt remaining in its unlocked state.

9. System as claimed in claim 1, wherein forward pivotal movement of the bolt is damped by a damping spring.

10. System as claimed in claim 1, wherein pivoting movement of the collar in a rearward direction is limited by an adjustable stop member.

11. System according to claim 10, wherein a spring element is provided inside of the sleeve in the case of the adjustable stop member formed by the sleeve, which spring element has an upper end and a lower end and is supported at its upper end by a top of the sleeve and at its lower end by a bottom of a cavity provided in the shell exercising a force onto the sleeve acting in the direction of the collar.

12. System according to claim 11, wherein the spring element is a coil spring.

* * * * *